US008796925B2

(12) United States Patent
Imai et al.

(10) Patent No.: US 8,796,925 B2
(45) Date of Patent: Aug. 5, 2014

(54) DISCHARGE TUBE

(75) Inventors: Koichi Imai, Hanyu (JP); Yoshikazu Hanamura, Kounosu (JP); Takeshi Nishigata, Gyouda (JP)

(73) Assignee: Okaya Electric Industries, Co., Ltd., Tokyo (JP)

( * ) Notice: Subject to any disclaimer, the term of this patent is extended or adjusted under 35 U.S.C. 154(b) by 0 days.

(21) Appl. No.: 13/698,138

(22) PCT Filed: May 10, 2011

(86) PCT No.: PCT/JP2011/060728

§ 371 (c)(1),
(2), (4) Date: Nov. 15, 2012

(87) PCT Pub. No.: WO2011/148780

PCT Pub. Date: Dec. 1, 2011

(65) Prior Publication Data

US 2013/0063025 A1 Mar. 14, 2013

(30) Foreign Application Priority Data

May 27, 2010 (JP) ..... 2010-003563
May 27, 2010 (JP) ..... 2010-003564
May 27, 2010 (JP) ..... 2010-003565
May 27, 2010 (JP) ..... 2010-003566

(51) Int. Cl.
*H01J 17/00* (2006.01)

(52) U.S. Cl.
USPC ..... 313/581; 361/117; 361/118

(58) Field of Classification Search
USPC ..... 361/117, 118, 120; 313/581
See application file for complete search history.

(56) References Cited

U.S. PATENT DOCUMENTS

| | | | | |
|---|---|---|---|---|
| 4,433,354 | A | 2/1984 | Lange et al. | |
| 5,633,777 | A * | 5/1997 | Boy et al. | 361/117 |
| 8,169,145 | B2 * | 5/2012 | Boy et al. | 313/631 |
| 8,189,315 | B2 * | 5/2012 | Boy et al. | 361/117 |
| 2006/0209485 | A1 | 9/2006 | Imai et al. | |
| 2007/0064372 | A1 * | 3/2007 | Loader et al. | 361/118 |
| 2010/0309598 | A1 * | 12/2010 | Boy et al. | 361/117 |

FOREIGN PATENT DOCUMENTS

| | | | |
|---|---|---|---|
| DE | 102007063316 | A1 | 2/2009 |
| JP | 57-145287 | A | 9/1982 |
| JP | 64-012487 | A | 1/1989 |
| JP | 2005-025953 | A | 1/2005 |
| JP | 3122357 | U | 5/2006 |
| JP | 3141985 | U | 5/2008 |

OTHER PUBLICATIONS

International Search Report of PCT/JP2011/060728, mailing date Aug. 9, 2011.

* cited by examiner

*Primary Examiner* — Mary Ellen Bowman
(74) *Attorney, Agent, or Firm* — Westerman, Hattori, Daniels & Adrian, LLP

(57) ABSTRACT

A discharge tube 10 includes first electrode 12, second electrode 14 and third electrode 16 which are arranged in parallel, airtight outer enclosure 22 including first tubular body 18 sandwiched between first electrode 12 and second electrode 14, and second tubular body 20 sandwiched between second electrode 14 and third electrode 16. Through-holes 24 is formed in second electrode 14 and allows internal spaces of first tubular body 18 and second tubular body 20 to communicate with each other. On first electrode 12 and third electrode 16, discharge electrode portions 26 are formed which protrude toward a center of airtight outer enclosure 22 and are disposed opposite to each other with discharge gap 28 provided in between, and discharge gas is filled in airtight outer enclosure 22. The discharge electrode portions 26 are inserted and arranged in through-hole 24 of second electrode 14.

2 Claims, 6 Drawing Sheets

DISCHARGE TUBE

TECHNICAL FIELD

The present invention relates to a discharge tube that is used as a switching spark gap for supplying a constant voltage for turning-on or igniting to a high pressure discharge lamp such as a metal halide lamp for a projector or an automobile, or an ignition plug of a gas cooker, or as a gas arrestor (lightning tube) for absorbing a surge voltage, and, in particular, relates to a discharge tube having a triode structure.

BACKGROUND ART

As such discharge tube, the applicant has previously submitted Japanese Utility Model Registration No. 3122357.

The discharge tube 60 as illustrated in FIGS. 10 and 11, includes a first electrode 62, a second electrode 64 and a third electrode 66 which are arranged in parallel, and an airtight outer enclosure 72 which includes a first cylindrical tube 68 made of an insulating material and sandwiched between the first electrode 62 and the second electrode 64 and a second cylindrical tube 70 made of an insulating material and sandwiched between the second electrode 64 and the third electrode 66.

In the second electrode 64 disposed in the center, a through-hole 74 is formed allowing the internal spaces of the first cylindrical tube 68 and the second cylindrical tube 70 to communicate with each other.

Moreover, the first electrode 62 and the third electrode 66 disposed on the left and right protrude toward a center of the airtight outer enclosure 72, respectively, and are provided with discharge electrode portions 76, 76 disposed inside the airtight outer enclosure 72. A discharge gap 78 is formed between the discharge electrode portions 76, 76 of the first electrode 62 and the third electrode 66. Hollow portions 62*b* and 66*b* are formed on the outer side surfaces of the first electrode 62 and the third electrode 66, respectively.

The first electrode 62, the second electrode 64 and the third electrode are airtightly joined with the first cylindrical tube 68 and the second cylindrical tube 70 through a sealant (not illustrated).

The circumferences 62*a*, 64*a* and 66*a* of the first electrode 62, the second electrode 64 and the third electrode 66, protrude to the outside from the outer peripheral surfaces 68*a* and 70*a* of the first cylindrical tube 68 and the second cylindrical tube 70, respectively.

A predetermined discharge gas is filled in the airtight outer enclosure 72.

In the discharge tube 60, when between the first electrode 62 and third electrode 66, a voltage equal to or higher than the discharge starting voltage of the discharge tube 60 is applied, a discharge is generated in the discharge gap 78.

CITATION LIST

Patent Literature

[Patent Literature 1] Japanese Utility Model Registration No. 3122357

SUMMARY OF INVENTION

Technical Problem

The discharge tube 60 is a discharge tube having a triode structure provided with the first electrode 62, the second electrode 64, and the third electrode 66, and generates a discharge between the first electrode 62 and the third electrode 66 which are disposed on both ends of the discharge tube. However, since the second electrode 64 is interposed between the first electrode 62 and the third electrode 66, discharge gaps, which is smaller than the discharge gap 78 formed between the first electrode 62 and the third electrode 66, is formed between the first electrode 62 and the second electrode 64 and between the third electrode 66 and the second electrode 64. Thus, after generating discharges between the first electrode 62 and the second electrode 64 and between the third electrode 66 and the second electrode 64 with the small gaps, the discharges shift to the discharge generation in the discharge gap 78 between the first electrode 62 and the third electrode 66, thereby causing a situation in which a discharge response characteristic becomes poor when a voltage is applied.

The invention has been carried out in view of the above-mentioned problem and aims to realize a discharge tube which is excellent in a discharge response characteristic when a voltage is applied.

Solution to Problem

In order to achieve the above-mentioned object, the discharge tube according to the present invention is a discharge tube including: a first electrode, a second electrode, and a third electrode arranged in parallel; and an airtight outer enclosure including a first tubular body made of an insulating material and sandwiched between the first electrode and the second electrode, and a second tubular body made of an insulating material and sandwiched between the second electrode and the third electrode, a through-hole being formed in the second electrode and allowing internal spaces of the first tubular body and the second tubular body to communicate with each other, on the first electrode and the third electrode, discharge electrode portions being formed which protrude toward a center of the airtight outer enclosure and are disposed opposite to each other with a predetermined discharge gap provided in between, and a discharge gas being filled in the airtight outer enclosure, wherein the discharge electrode portions of the first and third electrodes are inserted and arranged in the through-hole of the second electrode.

In the discharge tube described above, an insertion length of the discharge electrode portions of the first and third electrodes inserted and arranged in the through-hole of the second electrode is preferably two times or more a gap length of the discharge gap.

The discharge tube of the present invention is a discharge tube including: a first electrode, a second electrode, and a third electrode arranged in parallel; and an airtight outer enclosure including a first tubular body made of an insulating material and sandwiched between the first electrode and the second electrode, and a second tubular body made of an insulating material and sandwiched between the second electrode and the third electrode, a through-hole being formed in the second electrode and allowing internal spaces of the first tubular body and the second tubular body to communicate with each other, on the first electrode and the third electrode, discharge electrode portions being formed which protrude toward a center of the airtight outer enclosure and are disposed opposite to each other with a predetermined discharge gap provided in between, and a discharge gas being filled in the airtight outer enclosure, wherein on an end surface of the discharge electrode portion a film is formed containing cesium nitrate, rubidium nitrate, magnesium oxide and glass.

In the discharge tube of the present invention, content ratios of the cesium nitrate, the rubidium nitrate, the magnesium oxide and the glass are preferably in the range of 0.01 to 50% by weight for the cesium nitrate, in the range of 0.01 to 50% by weight for the rubidium nitrate, in the range of 0.01 to 50% by weight for the magnesium oxide and in the range of 0.01 to 50% by weight for the glass.

The discharge tube of the present invention is a discharge tube including: a first electrode, a second electrode, and a third electrode arranged in parallel; and an airtight outer enclosure including a first tubular body made of an insulating material and sandwiched between the first electrode and the second electrode, and a second tubular body made of an insulating material and sandwiched between the second electrode and the third electrode, a through-hole being formed in the second electrode and allowing internal spaces of the first tubular body and the second tubular body to communicate with each other, on the first electrode and the third electrode, discharge electrode portions being formed which protrude toward a center of the airtight outer enclosure and are disposed opposite to each other with a predetermined discharge gap provided in between, and a discharge gas being filled in the airtight outer enclosure, wherein the discharge gas includes neon in the range of 40 to 80% by volume, argon in the range of 5 to 50% by volume, and hydrogen in the range of 1 to 50% by volume, and the pressure of the gas filled into the airtight outer enclosure is set in the range of 25 to 100 kPa.

The discharge tube of the present invention is a discharge tube including: a first electrode, a second electrode, and a third electrode arranged in parallel; and an airtight outer enclosure including a first tubular body made of an insulating material and sandwiched between the first electrode and the second electrode, and a second tubular body made of an insulating material and sandwiched between the second electrode and the third electrode, a through-hole being formed in the second electrode and allowing internal spaces of the first tubular body and the second tubular body to communicate with each other, on the first electrode and the third electrode, discharge electrode portions being formed which protrude toward a center of the airtight outer enclosure and are disposed opposite to each other with a predetermined discharge gap provided in between, and a discharge gas being filled in the airtight outer enclosure, wherein on an inner wall surface of the first tubular body, there are formed a first trigger discharge film a back end of which is directly connected to the first electrode and a second trigger discharge film a back end of which is directly connected to the second electrode, while on an inner wall surface of the second tubular body, there are formed a first trigger discharge film a back end of which is directly connected to the third electrode and a second trigger discharge film a back end of which is directly connected to the second electrode.

In the discharge tube of the present invention, it is preferable that the first trigger discharge film formed on the inner wall surface of the first tubular body and the second trigger discharge film formed on the inner wall surface of the second tubular body are disposed on the same plane, while the first trigger discharge film formed on the inner wall surface of the second tubular body and the second trigger discharge film formed on the inner wall surface of the first tubular body are disposed on the same plane.

Advantageous Effects of Invention

In the discharge tube according to the present invention, the discharge electrode portions of the first and third electrodes that are disposed opposite to each other with a predetermined discharge gap provided in between are inserted and arranged in the through-hole of the second electrode. Thus, no discharge is generated between the first electrode and the second electrode, and between the third electrode and the second electrode as in the conventional discharge tube, but a discharge can be readily generated in the discharge gap between the discharge electrode portions of the first and third electrodes, while a discharge response characteristic is improved when a voltage is applied because of increasing an electric field by arranging the discharge gap that generates a discharge in the through-hole of the second electrode.

Note that in the discharge tube described above, that if the insertion length of the discharge electrode portions of the first and third electrodes inserted in the through-hole of the second electrode is set two times or more the gap length of the discharge gap, it will contribute to the improvement of a discharge response characteristic, because the discharge gap is disposed in a position where the electric field is high inside the through-hole.

In the discharge tube of the present invention, improvement of a discharge response characteristic can be realized when a voltage is applied, by forming a film that contains cesium nitrate, rubidium nitrate, magnesium oxide and glass, on the end surface of the discharge electrode portion.

In the discharge tube of the present invention, a discharge response characteristic is improved when a voltage is applied, by using a discharge gas composed of neon in the range of 40 to 80% by volume, argon in the range of 5 to 50% by volume, hydrogen in the range of 1 to 50% by volume, and the pressure of the filled gas against the airtight outer enclosure is in the range of 25 to 100 kPa.

In the discharge tube of the present invention, on an inner wall surface of the first tubular body, a first trigger discharge film a back end of which is directly connected to the first electrode and a second trigger discharge film a back end of which is directly connected to the second electrode are formed, and on an inner wall surface of the second tubular body, a first trigger discharge film a back end of which is directly connected to the third electrode and a second trigger discharge film a back end of which is directly connected to the second electrode are formed. Thus, since the back ends of the first and second trigger discharge films are directly connected to any of the first, second and third electrodes, electric field concentration is strong on the ends of the first trigger discharge film and the second trigger discharge film so that a high volume of electrons can be emitted, thereby improving a discharge response characteristic when a voltage is applied.

In the discharge tube, by arranging the first trigger discharge film formed on the inner wall surface of the first tubular body and the second trigger discharge film formed on the inner wall surface of the second tubular body on the same plane, and by arranging the first trigger discharge film formed on the inner wall surface of the second tubular body, and the second trigger discharge film formed on the inner wall surface of the first tubular body on the same plane, a discharge response characteristic can be improved, because creeping corona discharge can be generated inside the first tubular body 18 and inside the second tubular body 20, even in either case when a voltage to shift away from the first electrode to the third electrode is applied or when a voltage to shift away from the third electrode to the first electrode is applied.

In other words, in the case when voltage to shift away from the first electrode to the third electrode is applied, an electric field concentrates on the end of the first trigger discharge film in the first tubular body and electrons are emitted, creeping corona discharge is then generated between the end of the first trigger discharge film and the second electrode, while an electric field concentrates on the end of the second trigger discharge film in the second tubular body and electrons are emitted, creeping corona discharge is then generated between the end of the second trigger discharge film and the third electrode.

In addition, in the case when voltage to shift away from the third electrode to the first electrode is applied, an electric field concentrates on the end of the first trigger discharge film in the second tubular body and electrons are emitted, creeping corona discharge is then generated between the end of the first trigger discharge film and the second electrode, while an electric field concentrates on the end of the second trigger discharge film in the first tubular body and electrons are emitted, creeping corona discharge is then generated between the end of the second trigger discharge film and the first electrode.

REFERENCE SIGNS LIST

Figure 1:
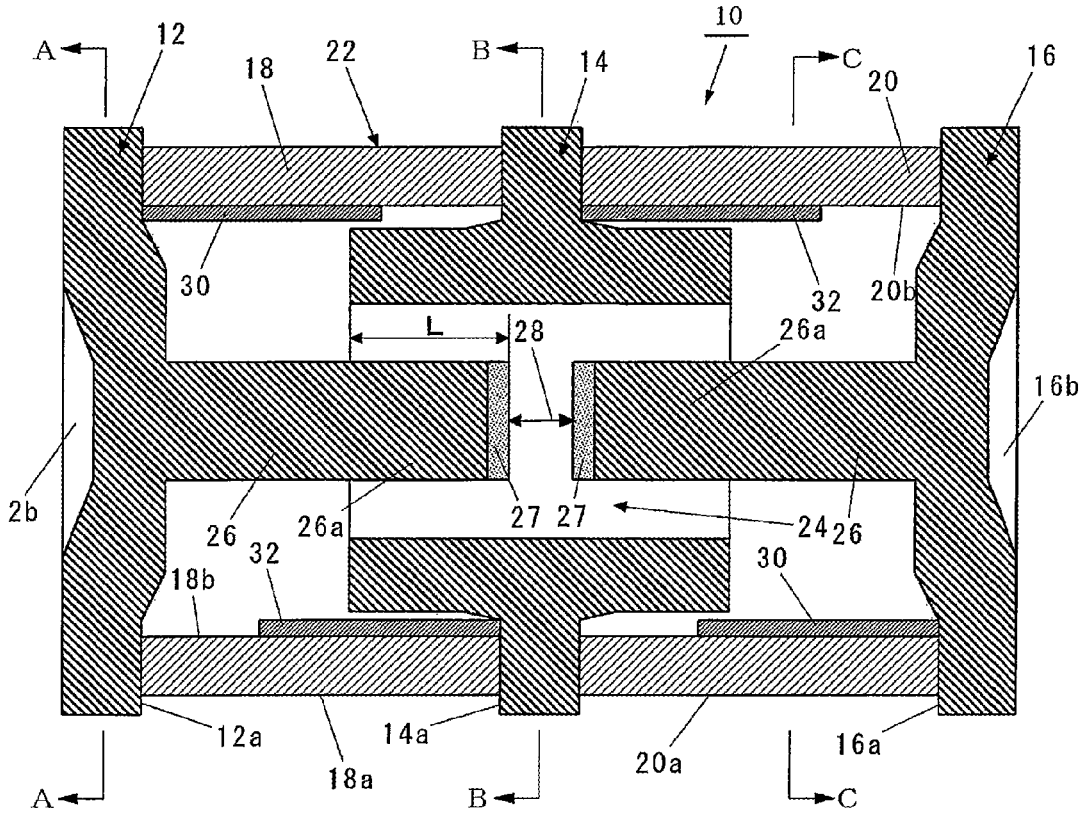
FIG. 1 is a schematic sectional view showing a discharge tube according to the present invention.

10 Discharge tube
12 First electrode
12A Circumference of first electrode
14 Second electrode
14A Circumference of second electrode
16 Third electrode
16A Circumference of third electrode
18 First tubular body
18A Outer wall surface of first tubular body
18B Inner wall surface of first tubular body
20 Second tubular body
20A Outer wall surface of second tubular body
20B Inner wall surface of second tubular body
22 Airtight outer enclosure
24 Through-hole
26 Discharge electrode portion
26A End portion of discharge electrode portion
27 Film
28 Discharge gap
30 First trigger discharge film
32 Second trigger discharge film
34 Cavity

DESCRIPTION OF EMBODIMENTS

Figure 2:
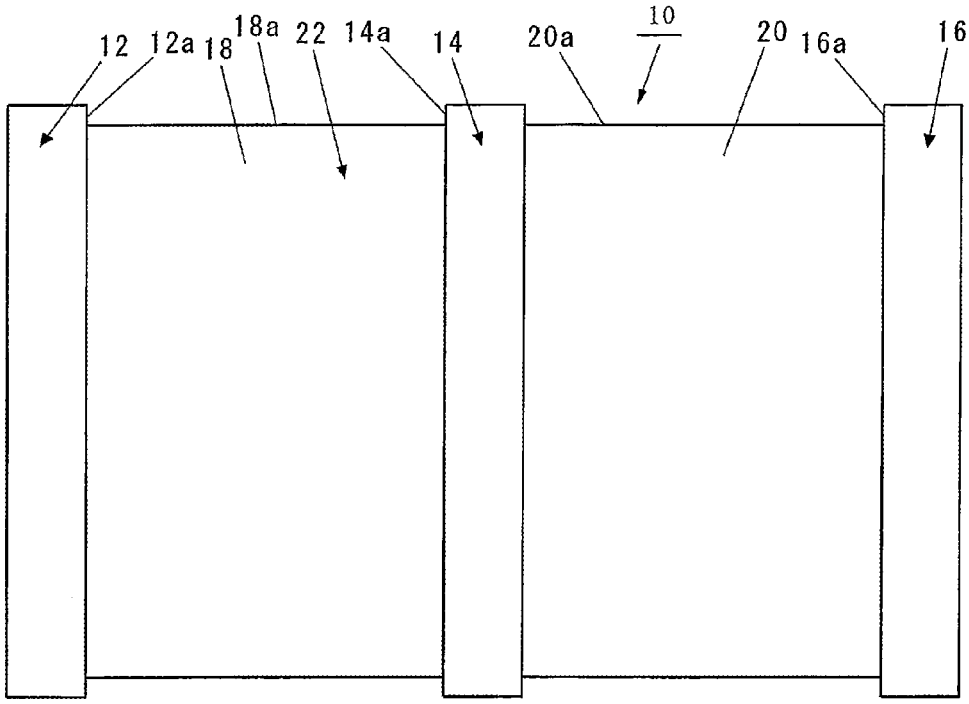
FIG. 2 is an elevation view showing the discharge tube according to the present invention.
Figure 3:
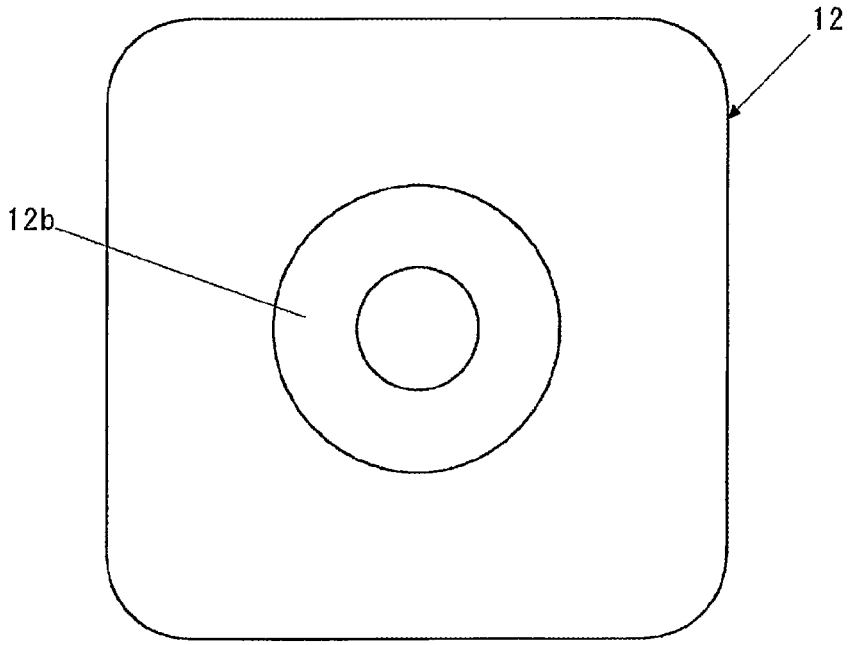
FIG. 3 is a left side view showing the discharge tube according to the present invention.
Figure 4:
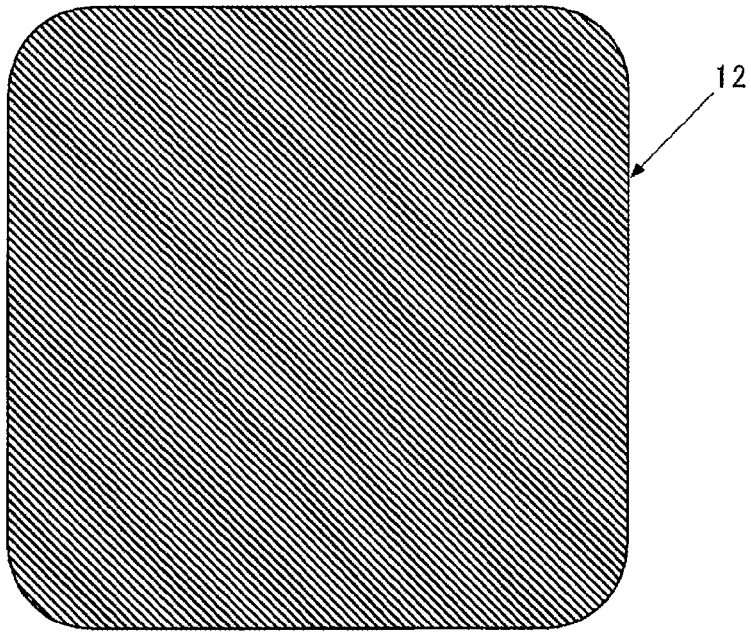
FIG. 4 is an A-A schematic sectional view of FIG. 1.
Figure 5:
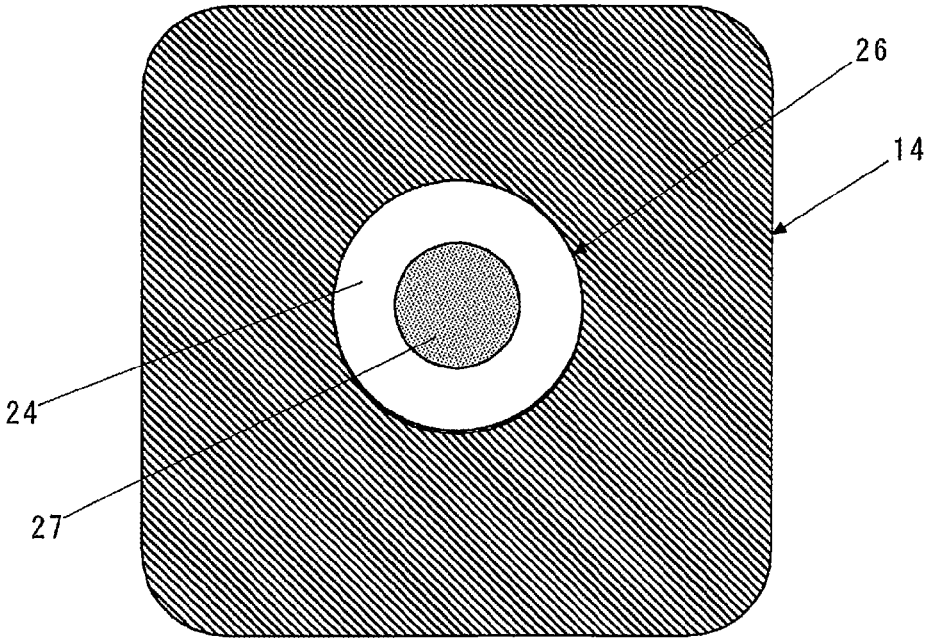
FIG. 5 is a B-B schematic sectional view along line B-B of FIG. 1.
Figure 6:
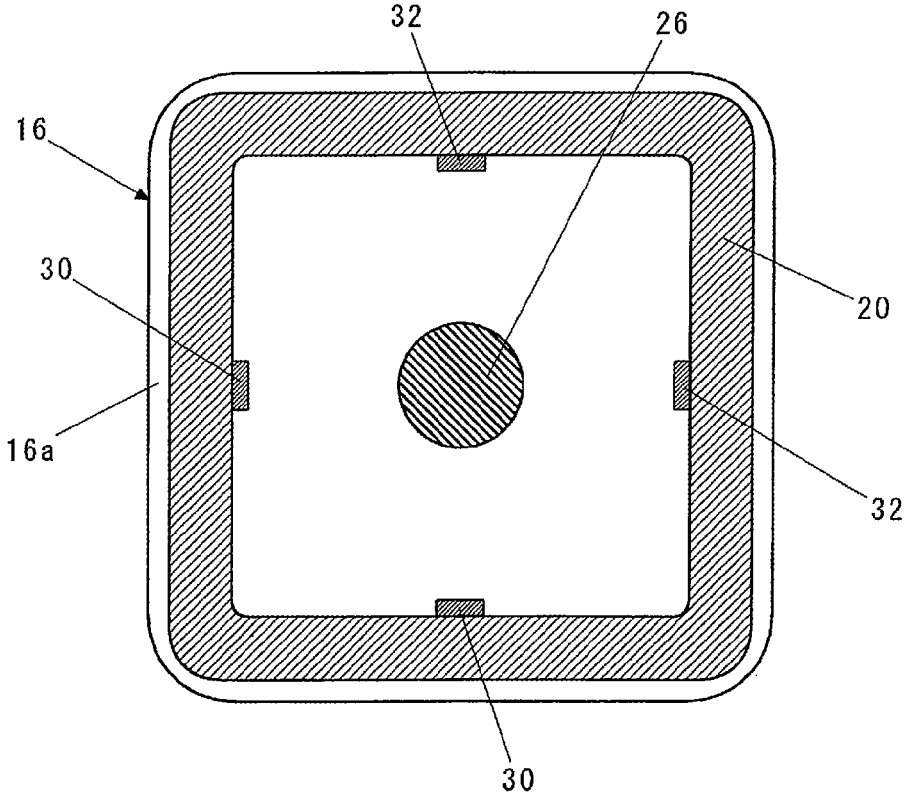
FIG. 6 is a C-C schematic sectional view of FIG. 1.

FIGS. 1 to 6 show a discharge tube 10 of the present invention. FIG. 1 is a schematic sectional view, FIG. 2 is an elevation view, FIG. 3 is a left side view, FIG. 4 is an A-A schematic sectional view of FIG. 1, FIG. 5 is a B-B schematic sectional view of FIG. 1 and FIG. 6 is a C-C schematic sectional view of FIG. 1.

The discharge tube 10 of the present invention is a discharge tube having a triode structure, including a first electrode 12, a second electrode 14 and a third electrode 16, which are arranged in parallel, and an airtight outer enclosure 22 including a first tubular body 18 of a quadrangular tubular shape, made of an insulating material such as ceramics and sandwiched between the first electrode 12 and the second electrode 14 and a second tubular body 20 of a quadrangular tubular shape, made of an insulating material such as ceramics and sandwiched between the second electrode 14 and the third electrode 16.

Note that, the first electrode 12, the second electrode 14 and the third electrode 16 are airtightly sealed from the first cylindrical body 18 and the second cylindrical body 20 via a sealant (not illustrated) such as silver solder.

On the second electrode 14 disposed in the center, sectional circular through-hole 24 is formed to allow the inner spaces of the first tubular body 18 and the second tubular body 20 to communicate with each other.

The first electrode 12 and the third electrode 16 disposed on the left end and right ends respectively protrude toward the center of the airtight outer enclosure 22 and each are provided with a cylindrical discharge electrode portion 26 an end portion 26*a* of which is inserted and arranged inside the through-hole 24 of the second electrode 14.

On the end surface of each discharge electrode portion 26 of the first electrode 12 and the third electrode 16, a film 27 has been formed containing cesium nitrate ($CsNO_3$), rubidium nitrate ($RbNO_3$), magnesium oxide (MgO) and glass.

By forming the film 27 from cesium nitrate ($CsNO_3$), rubidium nitrate ($RbNO_3$), magnesium oxide (MgO) and glass, the discharge response characteristic can be improved when a voltage is applied.

In other words, cesium nitrate and rubidium nitrate have a low work function and contribute to the improvement of response characteristic, because the emission of initial electrons is early when an impulse voltage is applied.

Further, by including magnesium oxide into the film 27, sputtering resistance characteristic is improved, while magnesium oxide contributes to the improvement of a response characteristic because of its high secondary electron emission coefficient.

Still further, when including glass in the film 27, exhaustion of the discharge electrode portion 26 due to discharge can be suppressed, because of excellent sputtering resistance characteristic of silicon dioxide ($SiO_2$) which is the main component of glass. Glass, having silicon dioxide as main component, may contain aluminum oxide ($Al_2O_3$) having excellent sputtering resistance characteristic, and may also contain calcium oxide (CaO), magnesium oxide (MgO), sodium oxide ($Na_2O$), potassium oxide ($K_2O$) which have a low work function and excellent electron emission characteristics.

The film 27 is formed according to the following method.

First, prepare a binder formed by dissolving sodium silicate in pure water, cesium nitrate powder, rubidium nitrate powder, magnesium oxide powder and glass powder.

Next, add the cesium nitrate powder, rubidium nitrate powder, magnesium oxide powder and glass powder into the binder and stir.

Then, coat the end surface of the first electrode 12 and the third electrode 16 with the binder to which the cesium nitrate powder, rubidium nitrate powder, magnesium oxide powder and glass powder are added.

After that, in the process of forming the airtight outer enclosure 22 in which the first electrode 12, the second electrode 14 and the third electrode 16 are joined with and sealed from the first tubular body 18 and the second tubular body 20, the water content in the binder evaporates in the process of heating, when performing vacuum evacuation while heating.

As a result, on the end surface of the first electrode 12 and the third electrode 16, the film 27 is formed containing cesium nitrate, rubidium nitrate, magnesium oxide and glass.

The content ratios of the cesium nitrate, the rubidium nitrate, the magnesium oxide and the glass are preferably in the range of 0.01 to 50% by weight for the cesium nitrate, in the range of 0.01 to 50% by weight for the rubidium nitrate, in the range of 0.01 to 50% by weight for the magnesium oxide and in the range of 0.01 to 50% by weight for the glass from the viewpoint of an improved discharge response characteristic when a voltage is applied.

As shown in FIG. 1, the end surface of the discharge electrode portion 26 of the first electrode 12 and the end surface of the discharge electrode portion 26 of the third electrode 16 are disposed opposite to each other with the predetermined discharge gap 28 provided in between.

Moreover, hollow portions 12*b* and 16*b* are formed on the outer side surfaces of the first electrode 12 and the third electrode 16.

The first electrode 12, the second electrode 14 and the third electrode 16 are formed of oxygen free copper or copper-zirconium obtained by containing zirconium (Zr) in oxygen free copper.

Note that, the insertion length L (refer to FIG. 1) of the discharge electrode portions 26 of the first electrode 12 and the third electrode 16 that are inserted in the through-hole 24 of the second electrode 14 is preferably two times or more the gap length of the above-mentioned discharge gap 28.

The circumferences 12*a*, 14*a* and 16*a* of the first electrode 12, the second electrode 14 and the third electrode 16, protrude to the outside from the outer wall surfaces 18*a*, 20*a* of the first tubular body 18 and the second tubular body 20.

Note that, as illustrated in the FIGS. 3 to 6, the outer shapes of the first electrode 12, the second electrode 14 and the third electrode 16 are substantially formed into a rounded edged regular square shape. In this way, in the discharge tube 10 of the present invention, because the circumferences 12*a*, 14*a* and 16*a* of the first electrode 12, the second electrode 14 and the third electrode 16, protrude to the outside from the outer wall surfaces 18*a* and 20*a* of the first tubular body 18 and the second tubular body 20, and because the outer shapes of the first electrode 12, the second electrode 14 and the third electrode 16 are substantially formed into a rounded edged regular square shape, the discharge tube 10 can be prevented from tumbling over when being mounted on the surface of a circuit board (illustration omitted), and thus packaging work can be easily performed.

In addition, on the inner wall surface 18*b* of the first tubular body 18, a plurality of linear first trigger discharge films 30 each back end of which is directly connected to the first electrode 12 and a plurality of linear second trigger discharge films 32 each back end of which is directly connected to the second electrode 14 are formed, respectively.

Similarly, on the inner wall surface 20*b* of the second tubular body 20, a plurality of linear first trigger discharge films 30 each back end of which is directly connected to the third electrode 16 and a plurality of linear second trigger discharge films 32 each back end of which is directly connected to the second electrode 14 are formed, respectively.

Note that, the end of the first trigger discharge film 30 and the end of the second trigger discharge film 32 are not directly connected to any of the first electrode 12, the second electrode 14 and the third electrode 16 and are an open end.

FIGS. 1 and 6 show an example in which a set of four first trigger discharge films 30 and second trigger discharge films 32 in the inner surface 20*b* of the second tubular body 20 are formed at even intervals of 90°. Although an illustration is omitted, in the inner wall surface 18*b* of the first tubular body 18 too, a set of four first trigger discharge films 30 and second trigger discharge films 32 are formed at even intervals of 90°.

Note that, the first trigger discharge film 30 and the second trigger discharge film 32 formed on the inner wall surface 18*b* of the first tubular body 18, and the first trigger discharge film 30 and the second trigger discharge film 32 formed on the inner wall surface 20*b* of the second tubular body 20 are disposed opposite to each other, respectively, at an interval of 180° (refer to FIGS. 1 and 6).

Further, the first trigger discharge film 30 formed on the inner wall surface 18*b* of the first tubular body 18, and the second trigger discharge film 32 formed on the inner wall surface 20*b* of the second tubular body 20 are disposed on the same plane. The first trigger discharge film 30 formed on the inner wall surface 20*b* of the second tubular body 20, and the second trigger discharge film 32 formed on the inner wall surface 18*b* of the first tubular body 18 are disposed on the same plane (refer to FIG. 1).

The first trigger discharge film 30 and the second trigger discharge film 32 are formed of an electrically conductive material such as a carbon based material. These first trigger discharge film 30 and second trigger discharge film 32 can be formed by rubbing a core material containing, for example, a carbon based material.

Furthermore, the airtight outer enclosure 22 is filled with a discharge gas containing neon (Ne), argon (Ar) and hydrogen ($H_2$).

In this case, the mixing ratios of neon, argon and hydrogen are in the range of 40 to 80% by volume for neon, in the range of 5 to 50% by volume for argon, and in the range of 1 to 50% by volume for hydrogen, while it is preferable from the viewpoint of the improvement of a discharge response characteristic when a voltage is applied that the pressure of the gas filled in the airtight outer enclosure 22 is in the range of 25 to 100 kPa.

The neon and argon ionize efficiently because of the Penning effect, and contribute to the improvement of the discharge response characteristic because of a low ionization voltage of the hydrogen.

In the discharge tube 10 of the present invention, when a voltage equal to or more than the discharge starting voltage of the discharge tube 10 is applied between the first electrode 12 and the third electrode 16 disposed on both ends, an electric field is concentrated at the ends of the first trigger discharge film 30 and the second trigger discharge film 32, thereby electrons are emitted and the creeping corona discharge is generated as the trigger discharge. Subsequently, the creeping corona discharge shifts to the glow discharge owing to the priming effect of the electrons. Then the glow discharge spreads to the discharge gap 28 between the discharge electrode portions 26, 26, and shifts to an arc discharge as a primary discharge.

In the discharge tube 10 of the present invention, end portions 26*a* of the discharge electrode portions 26 of the first electrode 12 and the third electrode 16 disposed on both ends of the airtight outer enclosure 22 are inserted in the through-hole 24 of the second electrode 14 disposed between the first electrode 12 and the third electrode 16, while the discharge electrode portion 26 of the first electrode 12 and the discharge electrode portion 26 of the third electrode 16 are disposed opposite to each other with a predetermined discharge gap 28 provided in between. Therefore, no discharge is generated between the first electrode 12 and the second electrode 14, and between the third electrode 16 and the second electrode 14 as in the conventional discharge tube 60, but a discharge can be readily generated in the discharge gap 28 between the discharge electrode portion 26 of the first electrode 12 and the discharge electrode portion 26 of the third electrode 16, while improving a discharge response characteristic when a voltage is applied because of increasing an electric field by arranging the discharge gap 28 to generate a discharge in the through-hole 24 of the second electrode 14.

Note that, as described above, if the insertion length L (refer to FIG. 1) of the discharge electrode portions 26 of the first electrode 12 and the third electrode 16 inserted in the through-hole 24 of the second electrode 14 is set two times or more the gap length of the discharge gap 28, it will contribute to the improvement of a discharge response characteristic, because the discharge gap 28 is disposed in a position where the electric field is high inside the through-hole 24.

In addition, the discharge tube 10 of the present invention, as described above, can realize the improvement of a discharge response characteristic when a voltage is applied because the films 27 containing cesium nitrate ($CsNO_3$), rubidium nitrate ($RbNO_3$), magnesium oxide (MgO) and glass are formed on the end surfaces of the discharge electrode portions 26 of the first electrode 12 and the third electrode 16.

Moreover, the discharge tube 10 of the present invention, as described above, is filled with the discharge gas composed of neon in the range of 40 to 80% by volume for neon, argon in the range of 5 to 50% by volume, and hydrogen in the range of 1 to 50% by volume in the airtight outer enclosure 22 at a gas pressure in the range of 25 to 100 kPa, thereby improving a discharge response characteristic when a voltage is applied.

Moreover, in the discharge tube 10 of the present invention, on the inner wall surface 18*b* of the first tubular body 18, the first trigger discharge film 30 the back end of which is directly connected to the first electrode 12 and the second trigger discharge film 32 the back end of which is directly connected to the second electrode 14 are formed. On the inner wall surface 20*b* of the second tubular body 20, the first trigger discharge film 30 the back end of which is directly connected to the third electrode 16 and the second trigger discharge film 32 the back end of which is directly connected to the second electrode 14 are formed. The back ends of the first trigger discharge film 30 and the second trigger discharge film 32 are directly connected to any of the first electrode 12, the second electrode 14 and the third electrode 16. Thus, the degrees of electric field concentration on the ends of the first trigger discharge films 30 and the second discharge films 32 are strong, a high volume of electrons can be emitted, and therefore, a discharge response characteristic can be improved when a voltage is applied.

Note that, as described above, the first trigger discharge film 30 and the second trigger discharge film 32 formed on the inner wall surface 18*b* of the first tubular body 18, and the first trigger discharge film 30 and the second trigger discharge film 32 formed on the inner wall surface 20*b* of the second tubular body 20 are disposed opposite to each other, respectively, at an interval of 180° (refer to FIGS. 1 and 6). This arrangement is provided in order to eliminate electric potential difference due to positive-negative polarity.

Moreover, as described above, the first trigger discharge film 30 formed on the inner wall surface 18*b* of the first tubular body 18 and the second trigger discharge film 32 formed on the inner wall surface 20*b* of the second tubular body 20 are arranged on the same plane, and the first trigger discharge film 30 formed on the inner wall surface 20*b* of the second tubular body 20, and the second trigger discharge film 32 formed on the inner wall surface 18*b* of the first tubular body 18 are arranged on the same plane (refer to FIG. 1).

As a result, in the case when voltage to shift away from the first electrode 12 to the third electrode 16 is applied, an electric field concentrates on the end of the first trigger discharge film 30 in the first tubular body 18 and electrons are emitted, creeping corona discharge is then generated between the end of the first trigger discharge film 30 and the second electrode 14, while an electric field concentrates on the end of the second trigger discharge film 32 in the second tubular body 20 and electrons are emitted, creeping corona discharge is then generated between the end of the second trigger discharge film 32 and the third electrode 16.

In addition, in the case when a voltage to shift away from the third electrode 16 to the first electrode 12 is applied, an electric field concentrates on the end of the first trigger discharge film 30 in the second tubular body 20 to emit electrons, creeping corona discharge is then generated between the end of the first trigger discharge film 30 and the second electrode 14, while an electric field concentrates on the end of the second trigger discharge film 32 in the first tubular body 18 to emit electrons, creeping corona discharge is then generated between the end of the second trigger discharge film 32 and the first electrode 12.

In this way, by arranging the first trigger discharge film 30 formed on the inner wall surface 18*b* of the first tubular body 18 and the second trigger discharge film 32 formed on the inner wall surface 20*b* of the second tubular body 20 on the same plane, and by arranging the first trigger discharge film 30 formed on the inner wall surface 20*b* of the second tubular body 20, and the second trigger discharge film 32 formed on the inner wall surface 18*b* of the first tubular body 18 on the same plane, a discharge response characteristic can be improved, because creeping corona discharge can be generated inside the first tubular body 18 and inside the second tubular body 20, even in either case when a voltage to shift away from the first electrode 12 to the third electrode 16 is applied or when a voltage to shift away from the third electrode 16 to the first electrode 12 is applied.

Figure 7:
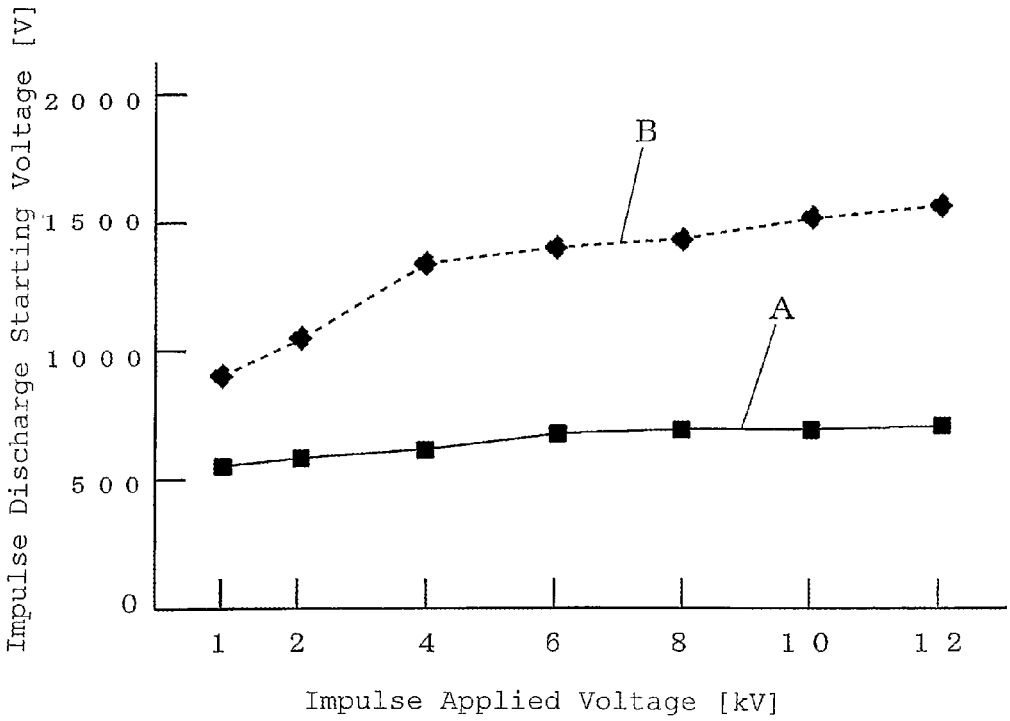
FIG. 7 is a graph showing a relationship between an impulse applied voltage and an impulse discharge starting voltage in the discharge tube of the present invention and in the conventional discharge tube.

FIG. 7 is a graph showing a relationship between an impulse applied voltage and an impulse discharge starting voltage in a discharge tube 10 of the present invention and in a conventional discharge tube 60. Note that, an impulse discharge starting voltage is the voltage value at which the discharge tube 10 or 60 starts the discharge in the case when a predetermined value of an impulse (surge) voltage is applied. The lower the impulse discharge starting voltage, the more excellent is the discharge response characteristic.

The film 27 of the discharge tube 10 of the present invention includes 2.54% cesium nitrate by weight, 7.61% rubidium nitrate by weight, 10.15% magnesium oxide by weight and 1.02% glass by weight. Moreover, a discharge gas composed of 70% neon by volume, 10% argon by volume and 20% hydrogen by volume is used, encapsulated at a gas pressure of 38.6 kPa.

On the other hand, the conventional discharge tube 60 uses a discharge gas composed of 55% neon by volume, 15% argon by volume and 30% krypton by volume, encapsulated at a gas pressure of 119.7 kPa.

An impulse discharge starting voltage has been calculated, when applying impulse voltages (½/50 μs) of 1 kV, 2 kV, 4 kV, 6 kV, 8 kV, 10 kV, and 12 kV to the discharge tube 10 of the present invention and to the conventional discharge tube 60.

As is shown in the graph in FIG. 7, in the case of the conventional discharge tube 60 (graph B of FIG. 7), the impulse discharge starting voltage when applying an impulse voltage of 1 kV is about 900 V and gradually increases to an impulse discharge starting voltage of about 1,500 V at an impulse voltage of 12 kV. Contrarily, in the case of the discharge tube 10 of the present invention (graph A of FIG. 7), the impulse discharge starting voltage when applying an impulse voltage of 1 kV is about 500 V and is about 600 V even when applying an impulse voltage of 12 kV, indicating that the discharge tube 10 of the present invention is excellent in a discharge response characteristic.

Figure 8:
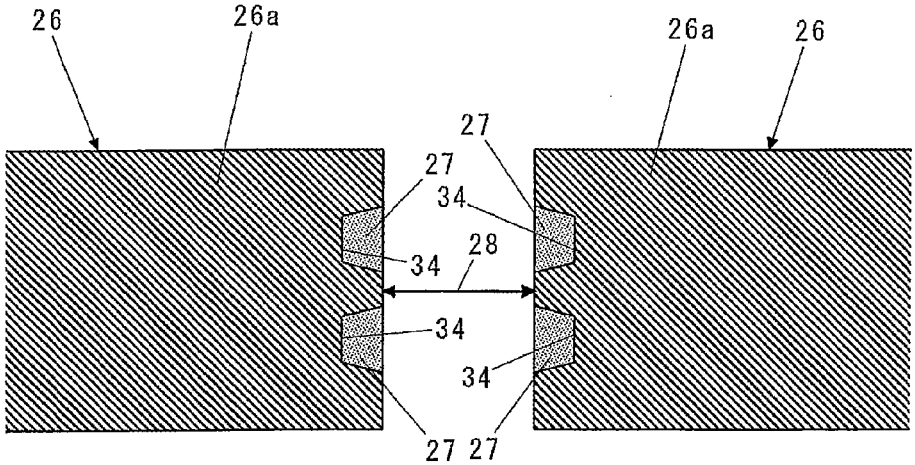
FIG. 8 is an enlarged sectional view showing the discharge electrode portion in a variation of the discharge tube according to the present invention.
Figure 9:
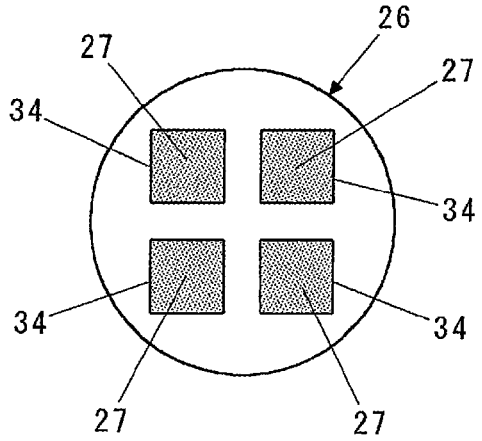
FIG. 9 is an enlarged sectional view showing the surface of the discharge electrode portion in a variation of the discharge tube according to the present invention.
Figure 10:
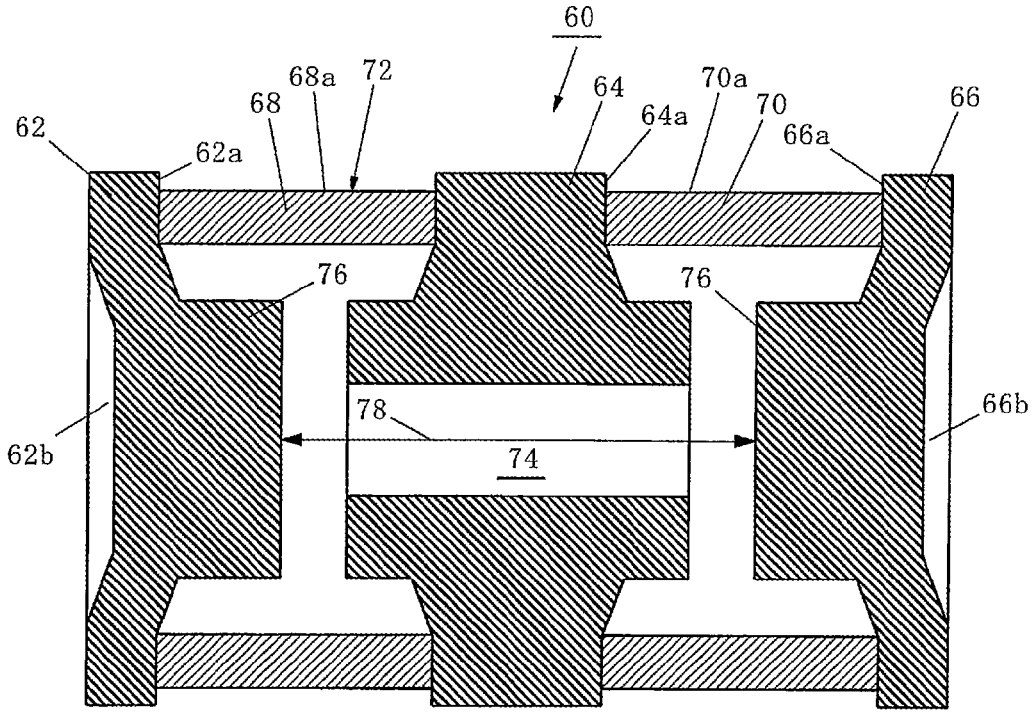
FIG. 10 is a schematic sectional view showing the conventional discharge tube.
Figure 11:
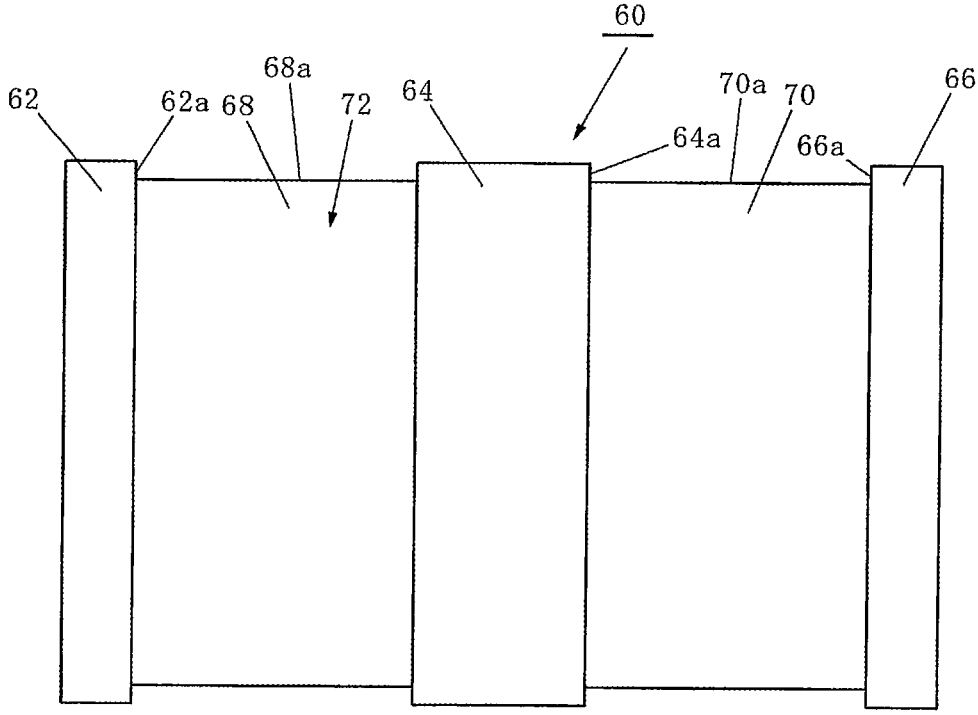
FIG. 11 is an elevation view showing the conventional discharge tube.

FIGS. 8 and 9 show a variation of the discharge tube 10 according to the present invention, where the variation of the discharge tube 10 is provided with multiple cavities 34 formed on the end surfaces of the discharge electrode portions 26 of the first electrode 12 and the third electrode 16 and is characterized in such a point that the films 27 are formed on the inner surface of the cavities 34.

Note that, in FIG. 8, the cavities 34 are formed in a sectional trapezoidal shape, but are not limited to this shape. The films 27 may be formed into a sectional longitudinal shape or a sectional circular shape.

In the variation of the discharge tube 10 according to the present invention, cavities 34 are formed on the surfaces of the discharge electrode portions 26, and because the films 27 are formed on the inner surfaces of the cavities 34, adhesion between the films 27 and discharge electrode portions 26 is improved, enabling suppression of sputtering of the films 27 due to strokes during discharge.

The invention claimed is:

1. A discharge tube comprising:

a first electrode, a second electrode, and a third electrode arranged in parallel; and an airtight outer enclosure including a first tubular body made of an insulating material and sandwiched between the first electrode and the second electrode, and a second tubular body made of an insulating material and sandwiched between the second electrode and the third electrode, a through-hole being formed in the second electrode and allowing internal spaces of the first tubular body and the second tubular body to communicate with each other, on the first electrode and the third electrode, discharge electrode portions being formed which protrude toward a center of the airtight outer enclosure and are disposed opposite to each other with a predetermined discharge gap provided in between, and a discharge gas being filled in the airtight outer enclosure, wherein on an end surface of the discharge electrode portion a film is formed containing cesium nitrate, rubidium nitrate, magnesium oxide and glass.

2. The discharge tube according to claim 1, wherein content ratios of the cesium nitrate, the rubidium nitrate, the magnesium oxide and the glass are in the range of 0.01 to 50% by weight for the cesium nitrate, in the range of 0.01 to 50% by weight for the rubidium nitrate, in the range of 0.01 to 50% by weight for the magnesium oxide and in the range of 0.01 to 50% by weight for the glass.

* * * * *